US006341669B1

(12) United States Patent
St. Pierre et al.

(10) Patent No.: US 6,341,669 B1
(45) Date of Patent: Jan. 29, 2002

(54) PIVOTING TERMINATION FOR ELEVATOR ROPE

(75) Inventors: Bruce St. Pierre, Bristol; Bruce P. Swaybill, Farmington, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/598,596

(22) Filed: Jun. 21, 2000

(51) Int. Cl.[7] ..... B66B 7/10

(52) U.S. Cl. ..... 187/412; 254/DIG. 12; 403/121

(58) Field of Search ..... 187/264, 411, 187/412; 254/DIG. 12; 403/52, 59, 61, 119, 121

(56) References Cited

U.S. PATENT DOCUMENTS

| | | | | | |
|---|---|---|---|---|---|
| 1,261,286 | A | * | 4/1918 | Pike | 187/412 |
| 1,500,816 | A | * | 7/1924 | Hobbs | 187/412 |
| 1,924,690 | A | * | 8/1933 | Lindstrom et al. | 187/412 |
| 1,958,039 | A | * | 5/1934 | Frost | 187/412 |
| 2,020,920 | A | * | 11/1935 | Vanderzee | 187/412 |
| 2,089,143 | A | * | 8/1937 | White | 187/412 |
| 5,490,577 | A | | 2/1996 | Yoo | |
| 5,611,412 | A | | 3/1997 | Yoo et al. | |
| 5,750,945 | A | | 5/1998 | Fuller et al. | |
| 5,862,888 | A | | 1/1999 | Iwakiri et al. | |

FOREIGN PATENT DOCUMENTS

| | | | | |
|---|---|---|---|---|
| GB | 897025 | * | 5/1962 | 187/411 |
| JP | 3-177289 | * | 8/1991 | 187/411 |
| SU | 541764 | * | 1/1977 | 187/411 |
| SU | 918236 | * | 4/1982 | 187/412 |

* cited by examiner

*Primary Examiner*—Thomas J. Brahan

(57) ABSTRACT

A pivoting hitch for an elevator rope includes a horizontal shaft or ball having a circular base and a flat top. The shaft or ball rests on a seat. An elevator rope is connected to a rod which passes through a hole in the shaft or ball and is suspended on the flat part of the shaft or ball by a spring. The shaft is used when multiple ropes are used to suspend an elevator car. When used with an overslung or underslung elevator car suspension, the pivoting hitch keeps the rope angles on both sides of the elevator car the same.

6 Claims, 2 Drawing Sheets

40
42
44
46

22
20b
β
54
42
51
52
53
20c
48
55
56
50

α
20a
24
20
26

PIVOTING TERMINATION FOR ELEVATOR ROPE

FIELD OF THE INVENTION

This invention pertains to the field of rope (cable) hitches and terminations, and in particular, to a pivoting termination for an elevator rope.

BACKGROUND OF THE INVENTION

An elevator is a hoisting and lowering mechanism equipped with a car or platform which moves in guides in a vertical direction. Electric elevators are suspended and moved by a series of pulleys (sheaves) and cables (ropes). In a typical arrangement, a wire rope is reeved over a number of sheaves, terminating in a hitch on the top and bottom of the car. Care is typically taken during the installation to mount the various sheaves in the machine room or on the car in such a manner as to ensure only vertical strain is applied to the wire ropes terminating in hitches. This reduces metal fatigue on the wire rope that would occur if subjected to horizontal bending forces.

Coated steel belts (CSB's) have been developed which are strong enough to replace the traditional wire cables used with elevators. These CSB's permit sheave and hitch arrangements that were not practical when using wire ropes. In an arrangement where the CSB hitch or termination is subjected to horizontal forces as well as vertical forces, metal fatigue is a concern.

SUMMARY OF THE INVENTION

Briefly stated, a pivoting hitch for an elevator rope includes a horizontal shaft or ball having a circular base and a flat top. The shaft or ball rests on a seat. An elevator rope is connected to a rod which passes through a hole in the shaft or ball and is suspended on the flat part of the shaft or ball by a spring. The shaft is used when multiple ropes are used to suspend an elevator car. When used with an overslung or underslung elevator car suspension, the pivoting hitch keeps the rope angles on both sides of the elevator car the same.

According to an embodiment of the invention, a pivoting hitch for an elevator rope includes a shaft being shaped as a right cylindrical prism, with a base having a circular arc joined at both ends by a straight line whereby the shaft has a flat portion and a rounded circular portion; at least one hole through the shaft, the at least one hole being substantially perpendicular to the flat portion; the rounded circular portion of the shaft resting on a seat, wherein a shape of the seat that makes contact with the shaft is congruent to the rounded circular portion of the shaft; the seat resting on a lower hitch plate; the lower hitch plate having at least one hole therein; at least one rod passing through the at least one hole in the lower hitch plate, through the at least one hole of the shaft, and through at least one spring; and an end of the at least one rod being connected to a termination for a rope, and another end of the at least one rod being connected to the spring.

According to an embodiment of the invention, a pivoting hitch for an elevator rope includes a shaft being shaped as a right cylindrical prism, with a base having a circular arc joined at both ends by a straight line whereby the shaft has a flat portion and a rounded circular portion; at least two holes through the shaft, the at least two holes being substantially perpendicular to the flat portion; the rounded circular portion of the shaft resting on a seat, wherein a shape of the seat that makes contact with the shaft is congruent to the rounded circular portion of the shaft; the seat resting on a lower hitch plate; the lower hitch plate having at least two holes therein; at least two rods each passing through a separate one of the at least two holes in the lower hitch plate, through a separate one of the at least two holes of the shaft, and through one spring each; and an end of each rod being connected to a separate termination for a rope, and another end of each rod being connected to the corresponding spring.

According to an embodiment of the invention, a pivoting hitch for an elevator rope includes a shaft being shaped as a right cylindrical prism, with a base having a circular arc joined at both ends by a straight line whereby the shaft has a flat portion and a rounded circular portion; at least one hole through the shaft, the at least one hole being substantially perpendicular to the flat portion; the rounded circular portion of the shaft resting on a seat, wherein a shape of the seat that makes contact with the shaft is congruent to the rounded circular portion of the shaft; the seat resting on a lower hitch plate; the lower hitch plate having at least one hole therein; at least one rod passing through the at least one hole in the lower hitch plate, through the at least one hole of the shaft, and through at least one spring; an end of the at least one rod being connected to a termination for a rope, and another end of the at least one rod being connected to the spring; and one side of the seat being contained by a hitch weldment and another side of the seat being contained by a side plate; wherein one side of the seat is contained by a hitch weldment and another side of the seat is contained by a side plate; and wherein the elevator rope is reeved from the pivoting hitch over a first sheave, a second sheave, and a drive sheave, and the first and second sheaves are attached to an elevator car that travels through a hoistway; wherein a first portion of the rope is between the pivoting hitch and the first sheave, a second portion of the rope is between the first sheave and the second sheave, a third portion of the rope is between the second sheave and the drive sheave, and a first rope angle between the first and second portions is equal to a second rope angle between the second and third portions.

DETAILED DESCRIPTION OF THE PREFERRED EMBODIMENT

Figure 1:
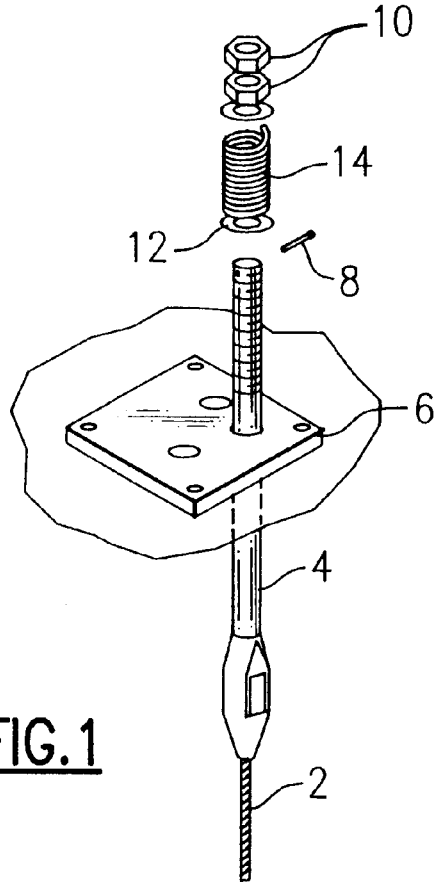
FIG. 1 shows a typical hitch (termination) according to the prior art.

Referring to FIG. 1, a wire rope 2 is connected to a thimble rod 4 which in turn is connected to a hitch plate 6. Thimble rod 4 is secured in place with a plurality of nuts 10 and a cotter pin 8. A centering washer 12 is sometimes used to keep thimble rod 4 aligned in hitch plate 6. A spring 14 is optionally used to ensure that the tension on all ropes remains equal. The word "rope" means a wire rope or a coated steel belt (CSB) as those terms are used in the elevator industry as well as a synthetic non-metallic rope such as is disclosed in U.S. Pat. No. 5,881,843 (SYNTHETIC NON-METALLIC ROPE FOR AN ELEVATOR).

Figures 2, 3:
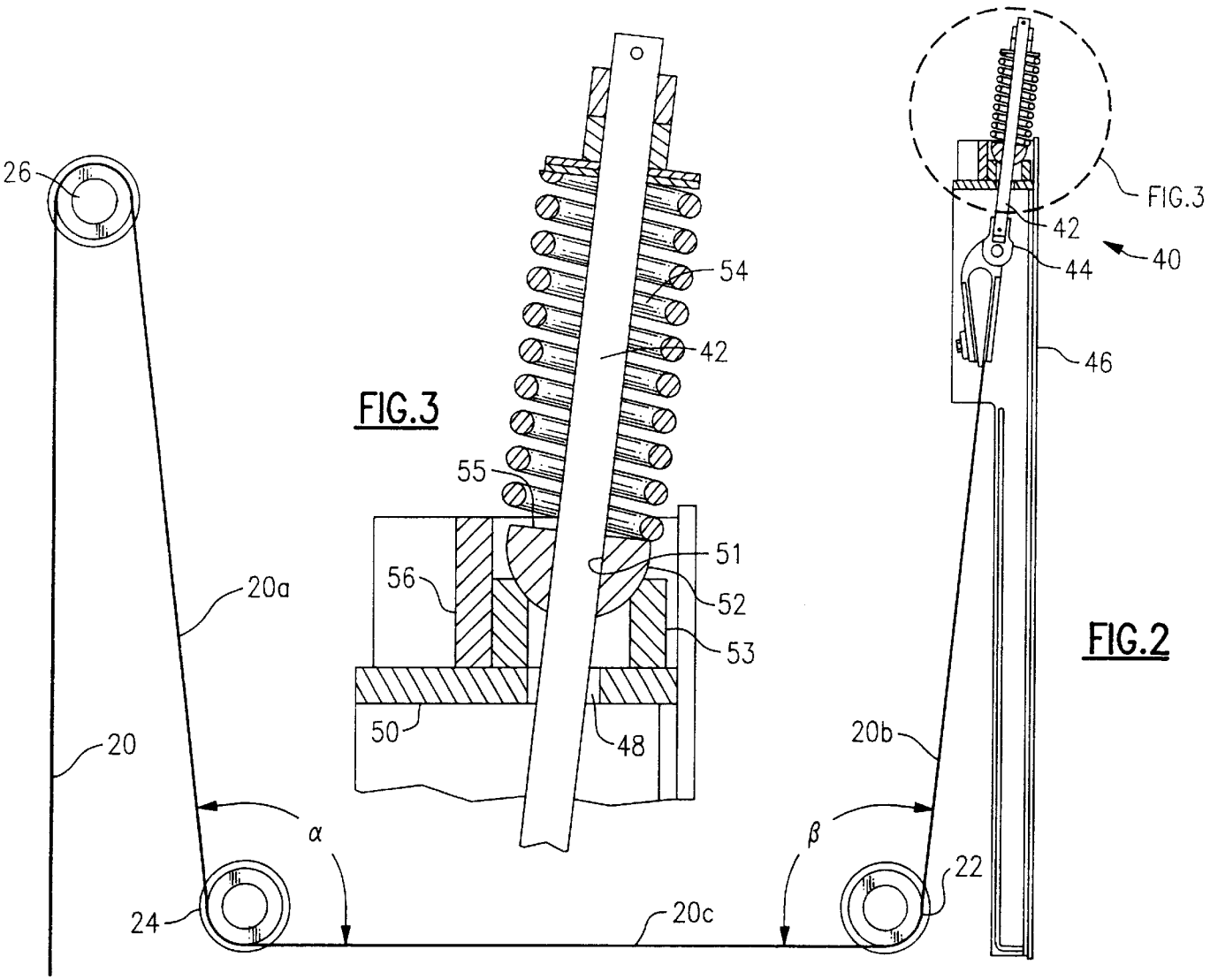
FIG. 2 shows an elevator car supported in an overslung fashion with a pivoting termination according to an embodiment of the invention.
FIG. 3 shows the pivoting termination of FIG. 2.

Referring to FIG. 2, a rope 20 is shown running from a pivoting hitch 40 to a first car sheave 22, then across a top of an elevator car (not shown) to a second car sheave 24, after which rope 20 runs to a drive sheave 26 and then to a counterweight (not shown). A rope portion 20*a* makes a rope angle α with a rope portion 20*c*, and a rope portion 20*b* makes a rope angle β with rope portion 20*c*. As the elevator car moves downward within a hoistway, rope angles α and β decrease, approaching a theoretical limit of 90° for an infinitely long hoistway. As the elevator car moves upward, rope angles α and β increase, and are at their maximum when the car is as high as it will go. In order to keep the elevator car horizontally centered, rope portion 20*c* must be kept horizontal, which means that rope angles α and β must be kept equal.

Pivoting hitch 40 includes a rod 42 which is shown here connected to rope 20, depicted here as coated steel belt (CSB), by a CSB termination 44. The lower end of rod 42 and CSB termination 44 are inside a car dead end hitch weldment 46.

Figure 4:
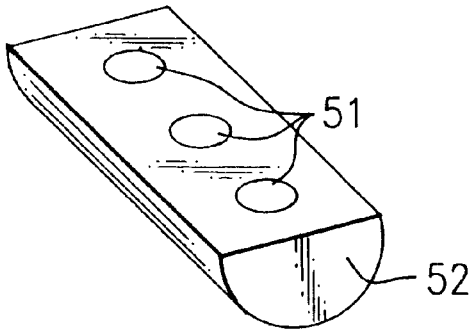
FIG. 4 shows a horizontal shaft used in an embodiment of the invention.

Referring to FIG. 3, rod 42 of pivoting hitch 40 runs from CSB termination 44, through a hole 48 in a hitch plate 50, and extending through a hole 51 in a shaft 52 where it is connected to the top of a spring 54. Shaft 52 is optionally a ball when a single rope is being terminated, but a shaft is used when a plurality of parallel ropes are being terminated. FIG. 4 shows a shaft 52 with a plurality of holes 51 for terminating three ropes.

A flat top 55 of shaft 52 receives spring 54. Spring 54 acts to maintain a stable tension on rope 20, which helps cushion the elevator car and its occupants. Shaft 52 is seated in a seat 53 which is preferably of a material such as Dupont's Delrin®, which is a very durable acetal engineering plastic with natural lubricity. The part of seat 53 which makes contact with shaft 52 is preferably contoured to match the corresponding contours of shaft 52 which make contact with seat 53. A plate 56 on one side of seat 53 is preferably included to contain seat 53, whereas another side of seat 53 is preferably contained by hitch weldment 46.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A pivoting hitch for an elevator rope, comprising:

a shaft being shaped as a right cylindrical prism, with a base having a circular arc joined at both ends by a straight line whereby said shaft has a flat portion and a rounded circular portion;

at least one hole through said shaft, said at least one hole being substantially perpendicular to said flat portion;

said rounded circular portion of said shaft resting on a seat, wherein a shape of said seat that makes contact with said shaft is congruent to said rounded circular portion of said shaft;

said seat resting on a lower hitch plate;

said lower hitch plate having at least one hole therein;

at least one rod passing through said at least one hole in said lower hitch plate, through said at least one hole of said shaft, and through at least one spring; and an end of said at least one rod being connected to a termination for a rope, and another end of said at least one rod being connected to said spring.

2. A pivoting hitch according to claim 1, wherein one side of said seat is contained by a hitch weldment and another side of said seat is contained by a side plate.

3. A pivoting hitch according to claim 1, wherein said elevator rope is reeved from said pivoting hitch over a first sheave, a second sheave, and a drive sheave, and said first and second sheaves are attached to an elevator car that travels through a hoistway; wherein a first portion of said rope is between said pivoting hitch and said first sheave, a second portion of said rope is between said first sheave and said second sheave, a third portion of said rope is between said second sheave and said drive sheave, and a first rope angle between said first and second portions is equal to a second rope angle between said second and third portions.

4. A pivoting hitch according to claim 1, wherein said elevator rope is a coated steel belt.

5. A pivoting hitch for an elevator rope, comprising:

a shaft being shaped as a right cylindrical prism, with a base having a circular arc joined at both ends by a straight line whereby said shaft has a flat portion and a rounded circular portion;

at least two holes through said shaft, said at least two holes being substantially perpendicular to said flat portion;

said rounded circular portion of said shaft resting on a seat, wherein a shape of said seat that makes contact with said shaft is congruent to said rounded circular portion of said shaft;

said seat resting on a lower hitch plate;

said lower hitch plate having at least two holes therein;

at least two rods each passing through a separate one of said at least two holes in said lower hitch plate, through a separate one of said at least two holes of said shaft, and through one spring each; and an end of each rod being connected to a separate termination for a rope, and another end of each rod being connected to said corresponding spring.

6. A pivoting hitch for an elevator rope, comprising:

a shaft being shaped as a right cylindrical prism, with a base having a circular arc joined at both ends by a straight line whereby said shaft has a flat portion and a rounded circular portion;

at least one hole through said shaft, said at least one hole being substantially perpendicular to said flat portion;

said rounded circular portion of said shaft resting on a seat, wherein a shape of said seat that makes contact with said shaft is congruent to said rounded circular portion of said shaft;

said seat resting on a lower hitch plate;

said lower hitch plate having at least one hole therein;

at least one rod passing through said at least one hole in said lower hitch plate, through said at least one hole of said shaft, and through at least one spring;

an end of said at least one rod being connected to a termination for a rope, and another end of said at least one rod being connected to said spring; and one side of said seat being contained by a hitch weldment and another side of said seat being contained by a side plate;

wherein one side of said seat is contained by a hitch weldment and another side of said seat is contained by a side plate; and wherein said elevator rope is reeved from said pivoting hitch over a first sheave, a second sheave, and a drive sheave, and said first and second sheaves are attached to an elevator car that travels through a hoistway; wherein a first portion of said rope is between said pivoting hitch and said first sheave, a second portion of said rope is between said first sheave and said second sheave, a third portion of said rope is between said second sheave and said drive sheave, and a first rope angle between said first and second portions is equal to a second rope angle between said second and third portions.

* * * * *